US010105568B2

(12) United States Patent
Golen, Jr. et al.

(10) Patent No.: US 10,105,568 B2
(45) Date of Patent: Oct. 23, 2018

(54) STAIR CLIMBER APPARATUSES AND METHODS OF OPERATING STAIR CLIMBER APPARATUSES

(71) Applicant: Brunswick Corporation, Lake Forest, IL (US)

(72) Inventors: Emil S. Golen, Jr., Barrington, IL (US); Young Chul Kim, Hickory Hills, IL (US); Jenny Slifko Manago, Gurnee, IL (US)

(73) Assignee: Brunswick Corporation, Mettawa, IL (US)

( * ) Notice: Subject to any disclaimer, the term of this patent is extended or adjusted under 35 U.S.C. 154(b) by 422 days.

(21) Appl. No.: 14/132,579

(22) Filed: Dec. 18, 2013

(65) Prior Publication Data

US 2015/0165263 A1 Jun. 18, 2015

(51) Int. Cl.
*A63B 24/00* (2006.01)
*A63B 22/04* (2006.01)
(Continued)

(52) U.S. Cl.
CPC ..... *A63B 22/04* (2013.01); *A63B 21/0058* (2013.01); *A63B 24/0087* (2013.01);
(Continued)

(58) Field of Classification Search
USPC ..... 482/1, 4, 7, 51, 52
See application file for complete search history.

(56) References Cited

U.S. PATENT DOCUMENTS 25,076 A 8/1859 Ames
783,769 A 5/1904 Wright
(Continued)

FOREIGN PATENT DOCUMENTS

EP 0890374 A1 * 1/1999
EP 0890374 A1 * 1/1999 ..... A63B 21/0053
(Continued)

OTHER PUBLICATIONS

International Search Report and Written Opinion, PCT/US2014/071225, dated Mar. 19, 2015.
(Continued)

*Primary Examiner* — Sundhara Ganesan
*Assistant Examiner* — Shila Jalalzadeh Abyan
(74) *Attorney, Agent, or Firm* — Andrus Intellectual Property Law, LLP

(57) ABSTRACT

Stair climber apparatuses have a control circuit that controls the speed and torque of an electric motor and controls an output torque direction of the electric motor. The control circuit controls the speed of the electric motor and the output direction of the electric motor to maintain a constant speed of travel of a plurality of stairs in a downward direction along an inclined support when an operator is stepping on the plurality of stairs in an upward direction. When a change in output torque direction of the electric motor torque is required to maintain the constant speed of travel of the plurality of stairs in the downward direction along the inclined support, the control circuit controls the speed of the electric motor down to a zero speed. Methods are for operating the stair climber apparatuses.

13 Claims, 10 Drawing Sheets

(51) Int. Cl.

| | |
|---|---|
| ***A63B 21/005*** | (2006.01) |
| *A63B 22/02* | (2006.01) |
| *A63B 71/06* | (2006.01) |

(52) U.S. Cl.

CPC ... *A63B 22/0235* (2013.01); *A63B 2024/0093* (2013.01); *A63B 2071/0655* (2013.01); *A63B 2071/0658* (2013.01); *A63B 2220/30* (2013.01); *A63B 2220/805* (2013.01); *A63B 2225/50* (2013.01); *A63B 2225/68* (2013.01); *A63B 2225/682* (2013.01); *A63B 2230/062* (2013.01)

(56) References Cited

U.S. PATENT DOCUMENTS

| | | | | |
|---|---|---|---|---|
| 4,927,136 | A | 5/1990 | Leask | |
| 4,938,474 | A * | 7/1990 | Sweeney | A63B 21/015 482/52 |
| 5,120,050 | A | 6/1992 | Fowell | |
| 5,135,447 | A | 8/1992 | Robards, Jr. et al. | |
| 5,145,475 | A | 9/1992 | Cares | |
| 5,295,928 | A * | 3/1994 | Rennex | 482/52 |
| 5,328,420 | A | 7/1994 | Allen | |
| 5,381,881 | A | 1/1995 | Meyer et al. | |
| 5,556,352 | A | 9/1996 | Chang | |
| 5,769,759 | A | 6/1998 | Alter et al. | |
| 6,855,093 | B2 | 2/2005 | Anderson et al. | |
| 6,905,441 | B2 | 6/2005 | Anderson et al. | |
| 7,052,439 | B2 | 5/2006 | Anderson et al. | |
| 7,204,361 | B2 | 4/2007 | Illedits | |
| 7,387,594 | B1 | 6/2008 | White et al. | |
| 2007/0170038 | A1 | 7/2007 | Howard et al. | |
| 2011/0177917 | A1 | 7/2011 | Patel | |
| 2012/0264572 | A1 * | 10/2012 | Fenster | A63B 22/04 482/52 |

FOREIGN PATENT DOCUMENTS

| | | |
|---|---|---|
| EP | 0 890 374 | 3/2003 |
| JP | H09240974 | 9/1997 |
| JP | 2012162353 | 8/2012 |

OTHER PUBLICATIONS

International Search Report and Written Opinion, PCT/US2014/071235, dated Apr. 7, 2015.

International Search Report and Written Opinion, PCT/US2014/071230, dated Apr. 3, 2015.

* cited by examiner

STAIR CLIMBER APPARATUSES AND METHODS OF OPERATING STAIR CLIMBER APPARATUSES

FIELD

The present disclosure relates to exercise equipment, for example stair climber apparatuses and methods of operating stair climber apparatuses.

BACKGROUND

U.S. Pat. No. 4,927,136 discloses an electromechanical and more particularly an electromagnetic brake that is utilized in the control of exercise equipment including escalator type stair-climbing apparatus, in which electronically controllable torque, including a clamping torque, is applied to a rotary shaft to load the exercise equipment, thereby giving complete electronic control to the operation of the exercise apparatus including a safety locking function.

U.S. Pat. No. 5,120,050 discloses a step type exerciser that comprises an endless loop of steps in which each step has an associated pair of pulleys, one at each end, and these run on fixed "inside out" Vee belts. This provides a particularly inexpensive guide means which is quiet in running. Drive is transmitted by toothed pinion blocks carried adjacent to each roller but angularly fixed whereas the rollers are rotatable, and the blocks engage a second belt which is driven by a motor.

U.S. Pat. No. 5,145,475 discloses an exerciser that provides low impact exercise for the upper and lower body of an operator. The apparatus includes an upper portion having moving rungs simulating a hand-over-hand motion to exercise one's upper body and a lower portion having moving platforms simulating a stair-like climbing motion to exercise one's lower body. The upper and lower portions are oriented at different angles to maximize operator comfort, the angle of the lower portion in particular providing clearance for one's knees during use. The exerciser also includes a variable speed control to adjustable vary the speed of the moving rungs and platforms, thereby adapting to the needs of various operator's.

U.S. Pat. No. 5,328,420 discloses a stair step exerciser that is mounted on a frame having horizontal and vertical components. A carriage comprised of a pair of side plates is pivoted to one end of a horizontal component and is retained at the other end in one of a series of vertical stops to selectively determine the angle of the carriage with respect to the frame. The carriage has pulleys at both ends which support the belts on which treads are pivoted at one end. The other end of the treads rest on one rail of a four bar linkage, which linkage expands as the carriage angle is decreased and collapses as the carriage angle is increased so as to always maintain the treads horizontal. A pair of hand cables is provided which move at substantially the same speed as the treads. The hand cables are mounted so as to be closer to the treads as the angle of the carriage increases and so as to move away from the treads as the angle of the carriage decreases.

U.S. Pat. No. 5,556,352 discloses a stair exerciser having a plurality of revolvable steps supported by endless chain conveyors and a control device for speed control, which, by the weight and action of an operator walking on the steps, enables the mechanism to run cyclical and continuous action thereby affording the operator stair climbing like exercises.

U.S. Pat. No. 5,769,759 discloses an apparatus for simulating stair climbing which allows selection of step height.

A side member is pivotally mounted to a base and oriented at a selected angle with respect to the base. A displacement mechanism mounted to the base is attached to the side member for rotating the side member with respect to the base. A series of platforms travels in a selected platform path including traveling along the side member. The top surface of each platform is a predetermined horizontal distance from the top surface of an adjacent platform which corresponds to the selected angle.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, a stair climber apparatus can comprise a frame having an inclined support that extends from a bottom portion to a top portion. Stairs in a plurality of stairs are connected together in series and travel in a loop around the inclined support. An electric motor is operably connected to the plurality of stairs. The electric motor operates to move the plurality of stairs in an upward direction along the inclined support and alternately operates so as to move the plurality of stairs in an opposite, downward direction along the inclined support. A control circuit controls a speed of the electric motor and controls an output torque or force direction of the electric motor between the forward direction and the reverse direction. The control circuit controls the speed of the electric motor and the output torque direction of the electric motor to maintain a constant speed of travel of the plurality of stairs in the downward direction along the inclined support when an operator is stepping on the plurality of stairs in the upward direction. When a change in output torque or force direction of the electric motor is required to maintain the constant rate of change of speed of travel of the plurality of stairs in the downward direction, the control circuit controls the speed of the electric motor down to a zero speed.

In certain other examples, methods are for operating a stair climber apparatus having an inclined support that extends from a bottom portion to a top portion; and a plurality of stairs that are connected together in series and travel in a loop around the inclined support. The methods can comprise controlling a speed and output torque or force direction of electric motor that is operably connected to the plurality of stairs, wherein the electric motor operates to move the plurality of stairs in an upward direction along the inclined support and wherein the electric motor alternately operates so as to move the plurality of stairs in an opposite, downward direction along the inclined support. The methods can further comprise controlling the speed of the electric motor and the output torque or force direction of the electric motor to maintain a constant speed of travel of the plurality of stairs in the downward direction along the inclined support when an operator is stepping on the plurality of stairs in the upward direction; and controlling the speed of the electric motor down to a zero speed when a change in output torque or force direction of the electric motor is required to maintain the constant speed of travel of the plurality of stairs in the downward direction.

BRIEF DESCRIPTION OF DRAWINGS

Examples of stair climber apparatuses and methods of operating stair climber apparatuses are described with reference to the following drawing figures. The same numbers are used throughout the figures to reference like features and components.

DETAILED DESCRIPTION OF DRAWINGS

Figure 1:
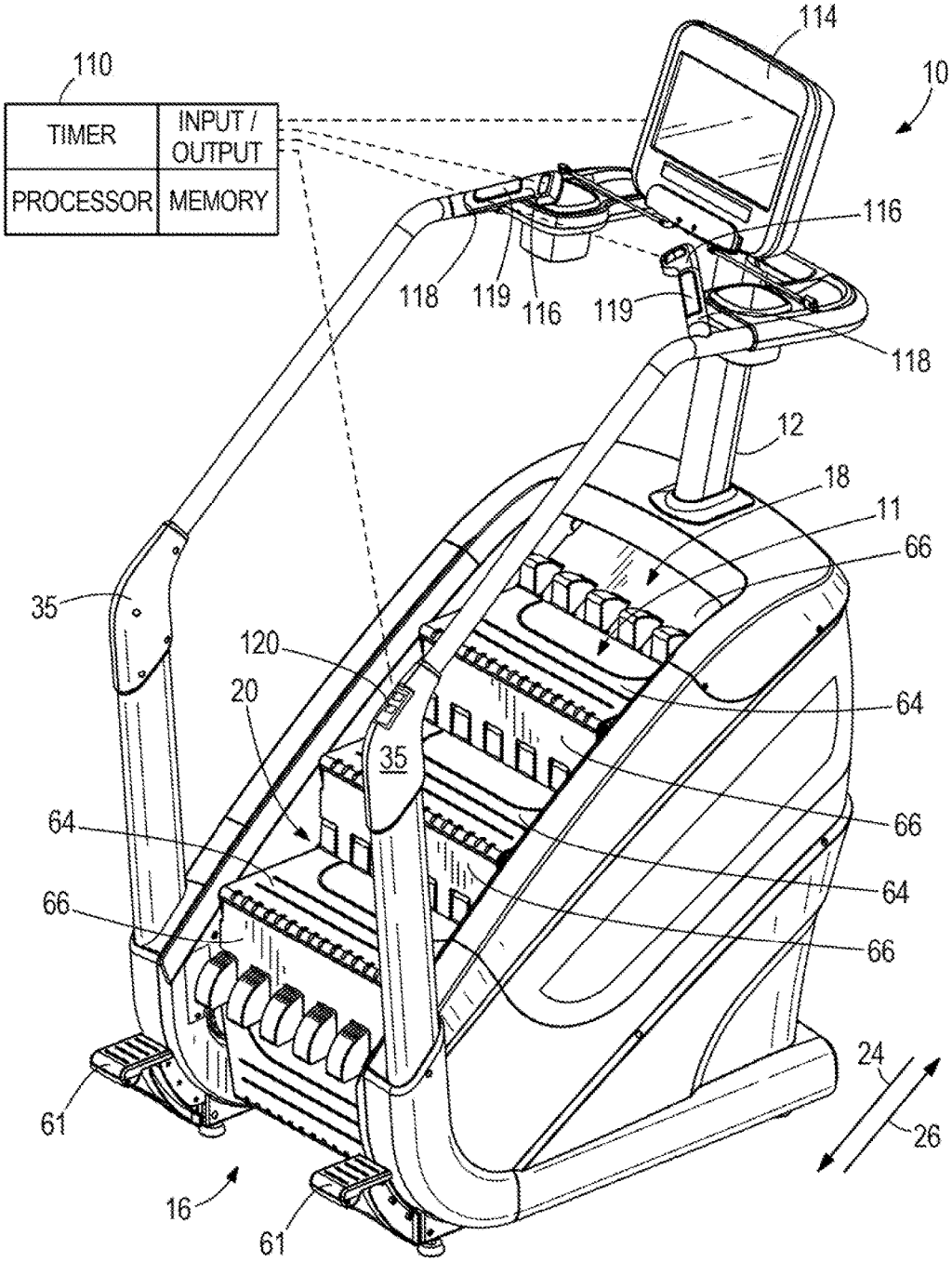
FIG. 1 is a perspective view of a stair climber apparatus.

In the present Description, certain terms have been used for brevity, clearness and understanding. No unnecessary limitations are to be implied therefrom beyond the requirement of the prior art because such terms are used for descriptive purposes only and are intended to be broadly construed. The different stair climber apparatuses, stair apparatuses, systems and methods described herein may be used alone or in combination with other apparatuses, systems and methods. Various equivalents, alternatives and modifications are possible within the scope of the appended claims. Each limitation in the appended claims is intended to invoke interpretation under 35 U.S.C. § 112, sixth paragraph only if the terms "means for" or "step for" are explicitly recited in the respective limitation.

FIGS. 1-4 depict personal exercise equipment, namely a stair climber apparatus 10 having a stair apparatus 11. The stair climber apparatus 10 has a frame 12 that defines an inclined support 14 extending from a lower end portion 16 to an upper end portion 18. A plurality of stairs 20 are connected together in series and travel together in a loop around the inclined support 14. An electric motor 22 is operatively connected to the plurality of stairs 20, as will be described further herein below. The type of electric motor 22 can vary, and in this example includes a conventional asynchronous electric motor, one example of which can be commercially obtained from Eul Ji. During operation, the electric motor 22 can be controlled to rotate an output shaft 28 in a first direction (e.g. forward or clockwise) to move the plurality of stairs 20 in a downward direction 24 with respect to the inclined support 14, and alternately to rotate the output shaft 28 in an opposite, second direction (e.g. reverse or counter-clockwise) to move the plurality of stairs 20 in an upward direction 26 with respect to the inclined support 14, all as will be further described herein below. The electric motor 22 can be operated as a brake to maintain constant speed of movement of the plurality of stairs 20 as an operator steps upwardly on the plurality of stairs 20 (thus providing downward force on the stairs), and/or to slow the speed of movement of the plurality of stairs 20 down to a zero speed, as will be discussed further herein below.

Figure 2:
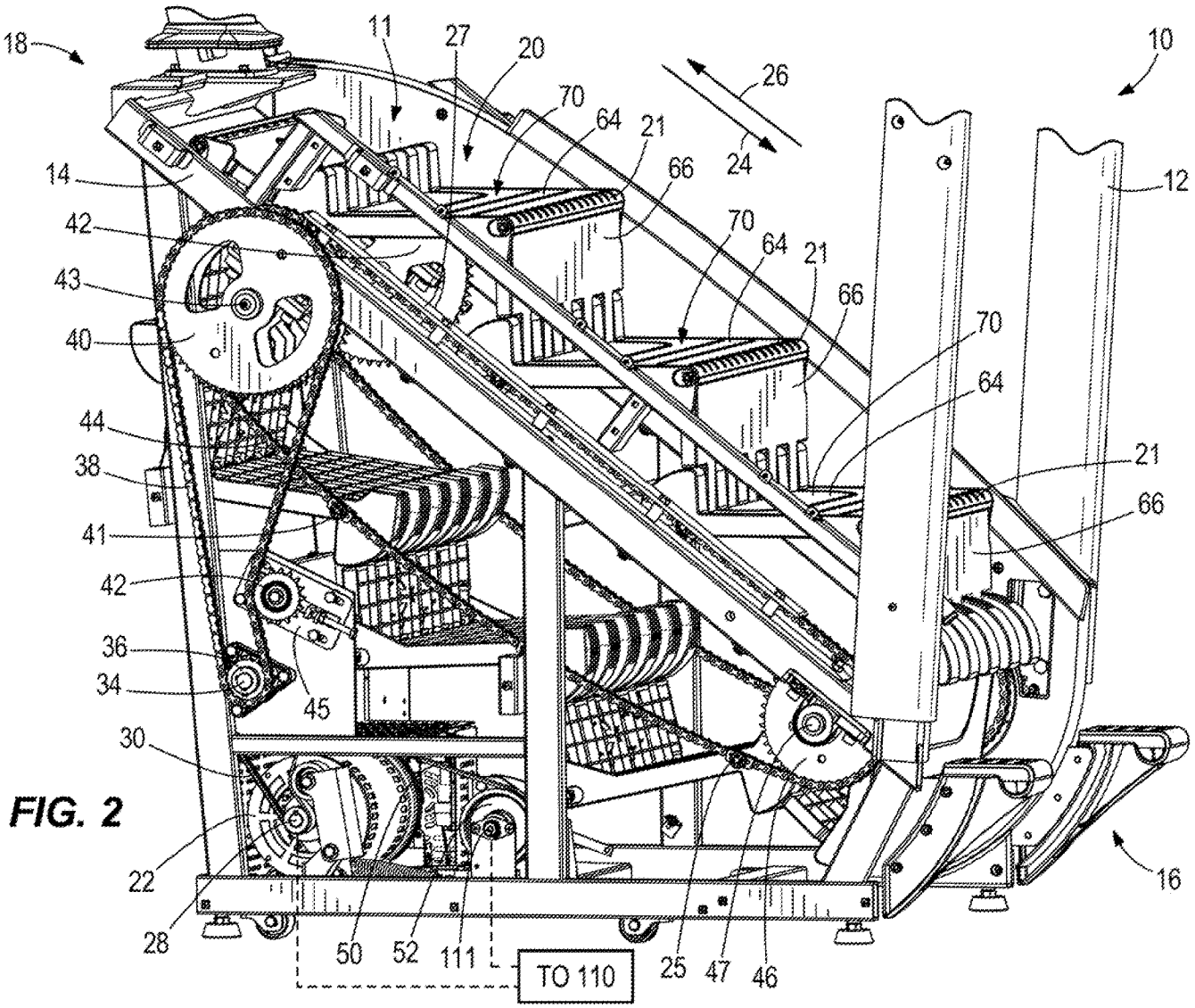
FIG. 2 is a perspective view of the apparatus shown in FIG. 1, having some parts removed for illustration.
Figure 3:
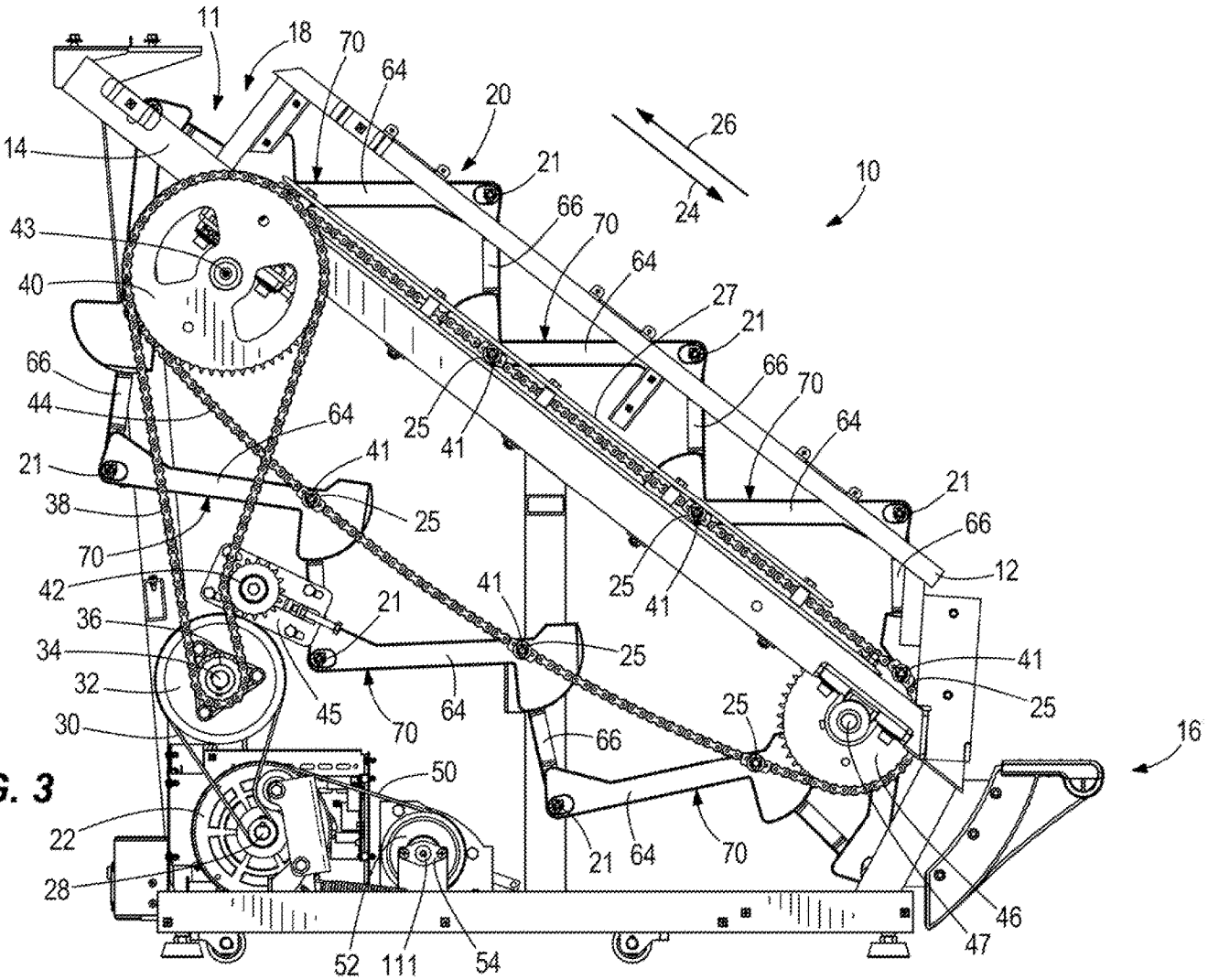
FIG. 3 is a side view of the apparatus shown in FIGS. 2 and 3, having additional parts removed for illustration.
Figure 4:
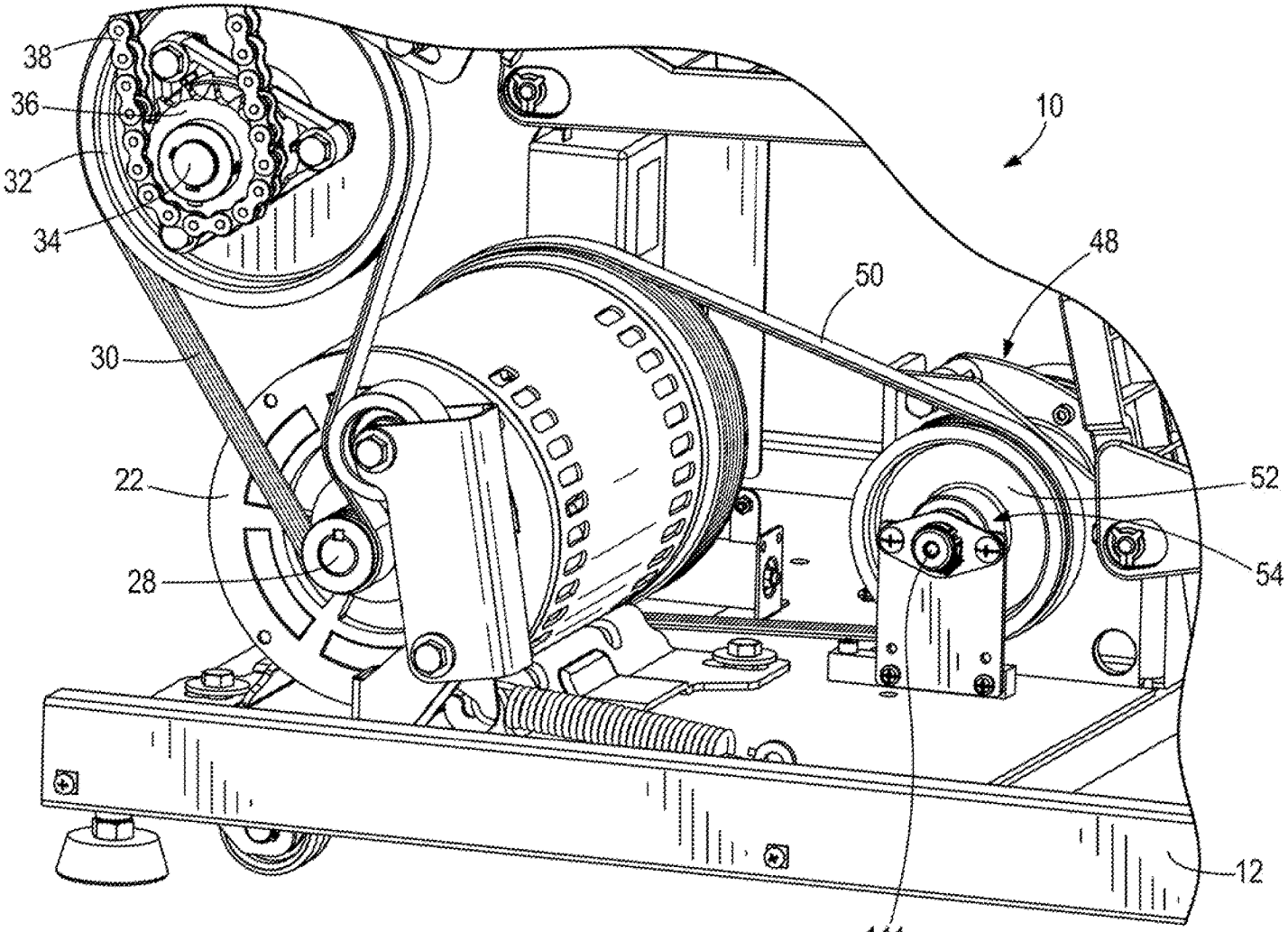
FIG. 4 is a closer view of an electric motor and mechanical brake on the apparatus of FIG. 1.

Referring to FIGS. 2-4, rotation of the output shaft 28 of the electric motor 22 rotates a drive belt 30, which is connected to and rotates a pulley 32 (see FIGS. 3 and 4) about a center live shaft 34. The drive belt 30 is tensioned by a spring 31 that biases an idler roller 29 about a pivot point 33 and against the drive belt 30. Rotation of the pulley 32 about its center live shaft 34 causes corresponding rotation of a lower sprocket 36. Rotation of the lower sprocket 36 causes rotation of a vertically-oriented chain 38 around a loop. The vertically-oriented drive chain 38 rotates around the lower sprocket 36 and an upper sprocket 40. The chain 38 is tensioned by an idler sprocket 42 that abuts against the chain 38 and is laterally adjustable by an adjustment plate 45 that can be fixed at several different positions with respect to the frame 12 to modify the tension. Rotation of the chain 38 causes rotation of the upper sprocket 40 and its center live shaft 43. Rotation of the upper sprocket 40 and the center live shaft 43 causes synchronous rotation of a pair of inner sprockets 42 (only one shown in FIG. 2) that are located on opposite sides of the inclined support 14 and are keyed to the center live shaft 43 for rotation therewith. Rotation of the pair of inner sprockets 42 causes rotation of a pair of drive chains 44 that are located on opposite sides of the inclined support 14. The pair of drive chains 44 angularly extends along the inclined support 14 and is driven in a loop around a lower pair of sprockets 46 and center live shaft 47, which are located at the lower end portion 16 of the inclined support 14.

The drive chains 44 support the plurality of stairs 20 as the stairs 20 travel in the noted loop around the inclined support 14. Each of the stairs 20 has a tread 64 and a riser 66. The tread 64 and the riser 66 are pivotably connected together at a conventional hinge formed by a pivot shaft 21 that extends along a first pivot axis 68 (see FIGS. 5 and 7). The tread 64 has a tread surface 70 that supports an operator's foot 73 (see FIG. 6) as the operator steps onto the stair 20. Each stair 20 in the plurality is connected to an adjacent stair 20 in the plurality by a pivot shaft 41 that extends along a second pivot axis 99 (see FIGS. 5 and 7) that is parallel to the first pivot axis 68. The pivot shaft 21 has opposite ends 23 that carry bearings 25. Each bearing 25 is attached to one of the pair of drive chains 44 and is configured to ride along a bearing support 27 that extends along the inclined support 14 from the lower end portion 16 to the upper end portion 18.

Figure 6:
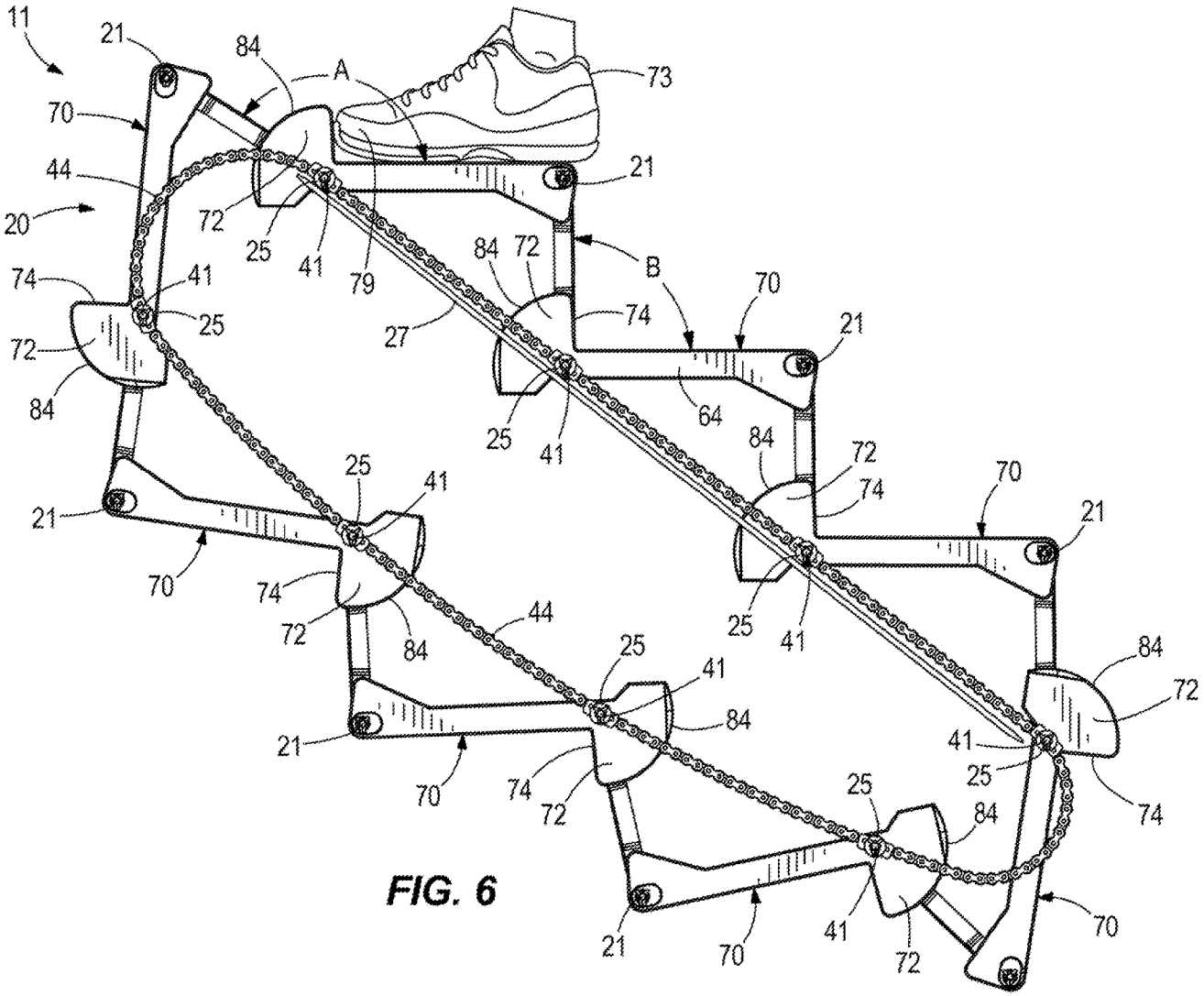
FIG. 6 is a side view of the stair apparatus shown in FIG. 5.

Rotation of the pair of drive chains 44 carries the bearings 25 around the inner sprockets 42 at the upper end portion 18 and around the lower sprockets 46 at the lower end portion 16. As the bearings 25 rotate around the inner sprockets 42 and lower sprockets 46, the bearings 25 are fed into the bearing support 27 and received from the bearing support 27, or vice versa depending upon the direction of operation of the electric motor 22. The stairs 20, via the bearings 25 and the pivot shafts 21, travel with the pair of drive chains 44 around the respective sprockets 42, 46. During said movement, the stairs 20 pivot by gravity with respect to each other along the pivot shafts 41. The tread 64 and riser 66 of each stair 20 also pivot by gravity with respect to each other along the pivot shafts 21. The stairs 20 are configured so that the riser 66 pivots towards the tread 64 up until the bearings 25 begin to ride along the bearing support 27. As the bearings 25 exit the bearing support 27, the tread 64 and riser 66 are configured to pivot away from each other. These pivoting movements of the stairs 20 are shown in FIG. 6.

Referring to FIG. 4, the electric motor 22 is connected to a mechanical brake 48 via a braking belt 50. The type of mechanical brake 48 can be a conventional item and in one example the mechanical brake 48 can include a solenoid actuator that actuates a brake pad to prevent movement of a pulley 52. Actuation of the mechanical brake 48 prevents rotation of a pulley 52 about its center shaft 54, which in turn prevents rotation of the electric motor 22 via the braking belt 50.

The stair climber apparatus 10 also has a control circuit 110 for controlling movement of the stair apparatus 11. The control circuit 110 includes a programmable processor, a memory, a timer, and an input/output device. The processor is communicatively connected to a computer readable medium that includes volatile or nonvolatile memory upon which computer readable code is stored. The processor can access the computer readable code on the computer readable medium, and upon executing the code, can send signals to carry out functions according to the methods described herein below. Execution of the code allows the control circuit 110 to control (e.g. actuate) a series of devices on the stair climber apparatus 10, including but not limited to the electric motor 22. The control circuit 110 may also read values from sensors, and interpret the data using look-up tables or algorithms stored in the memory. Such sensors can include but are not limited to an encoder 111 for detecting and communicating speed and direction of the plurality of stairs 20 to control circuit 110. Such sensors can also include, for example, sensors associated with various operator input devices, which will be further described herein below. The control circuit 110 can be connected to the devices (such as for example the electric motor 22 and various sensors) with which it communicates via conventional wired and/or wireless communication links. It should be noted that the dashed lines shown in FIGS. 1 and 2 are meant to show only that various devices are capable of communicating with the control circuit 110, and do not necessarily represent actual wiring connecting the devices, nor do they represent the only paths of communication between the devices. Further, it should be understood that the control circuit 110 could additionally or alternatively have many separate and/or communicatively interconnected control circuits or control units/sections at various locations on the stair climber apparatus 10.

As mentioned above, several operator input devices are provided on the stair climber apparatus 10 for communicating operator commands to the control circuit 110. The operator input devices can include, for example one or more conventional video/touch control panels 114 and/or one or more conventional speed control push buttons 116 located on handle members 118. The video/touch control panels 114 and/or buttons 116 can communicate operator inputs to the control circuit 110 for operating the stair climber apparatus 10 according to one or more predetermined exercise programs having certain time periods and providing certain resistance characteristics. Additional the operator input devices can include, for example heart rate monitors 119 located on the handle members 118 for communicating heart rate of the operator for communication to the control circuit 110. The operator input devices are not limited to these types of devices and can also or alternatively include devices for providing output devices such as visual, audial, tactile, and/or other sensory feedback to the operator. The operator inputs to the control circuit 110 via the operator input devices are acted upon by the control circuit 110 to control operation of the stair climber apparatus 10 according to various programs, which include programs for affecting the speed and direction of movement of the plurality of stairs 20 via the electric motor 22. Thus, when the operator is located on the stair climber apparatus 10, the operator can input, via the various input devices, speed commands to the control circuit 110 for controlling speed of movement and direction of movement of the plurality of stairs 20, as will be understood by those having ordinary skill in the art. A operator boarding (i.e. second) operator input device 120 is also located at the lower end portion 16 of the inclined support 14 and will be described further herein below.

During operation, as the operator steps forwardly (i.e. in the upward direction 26) along the inclined support 14, the electric motor 22 rotates the output shaft 28 to move the plurality of stairs 20 in the downward direction 26 with respect to the inclined support 14. A specific speed of movement of the plurality of stairs 20 can be selected (i.e. set) by the operator via one of the noted input devices. Based upon this input, the control circuit 110 is programmed to control the output torque and speed of the electric motor 22 to maintain the speed of movement of the plurality of stairs at a constant speed selected by the operator, despite physical characteristics of the operator and/or the changes in stepping speed of the operator. The speed of the stairs 20 and direction of movement of the stairs 20 is sensed and communicated to the control circuit 110 via the encoder 111, as is conventional. Based upon this information, the control circuit 110 adjusts the power (e.g. current) to the electric motor 22 to thereby affect the speed of the electric motor 22. Power can be supplied to the electric motor 22 via a conventional power cord, and/or one or more batteries, and/or the like.

Figure 5:
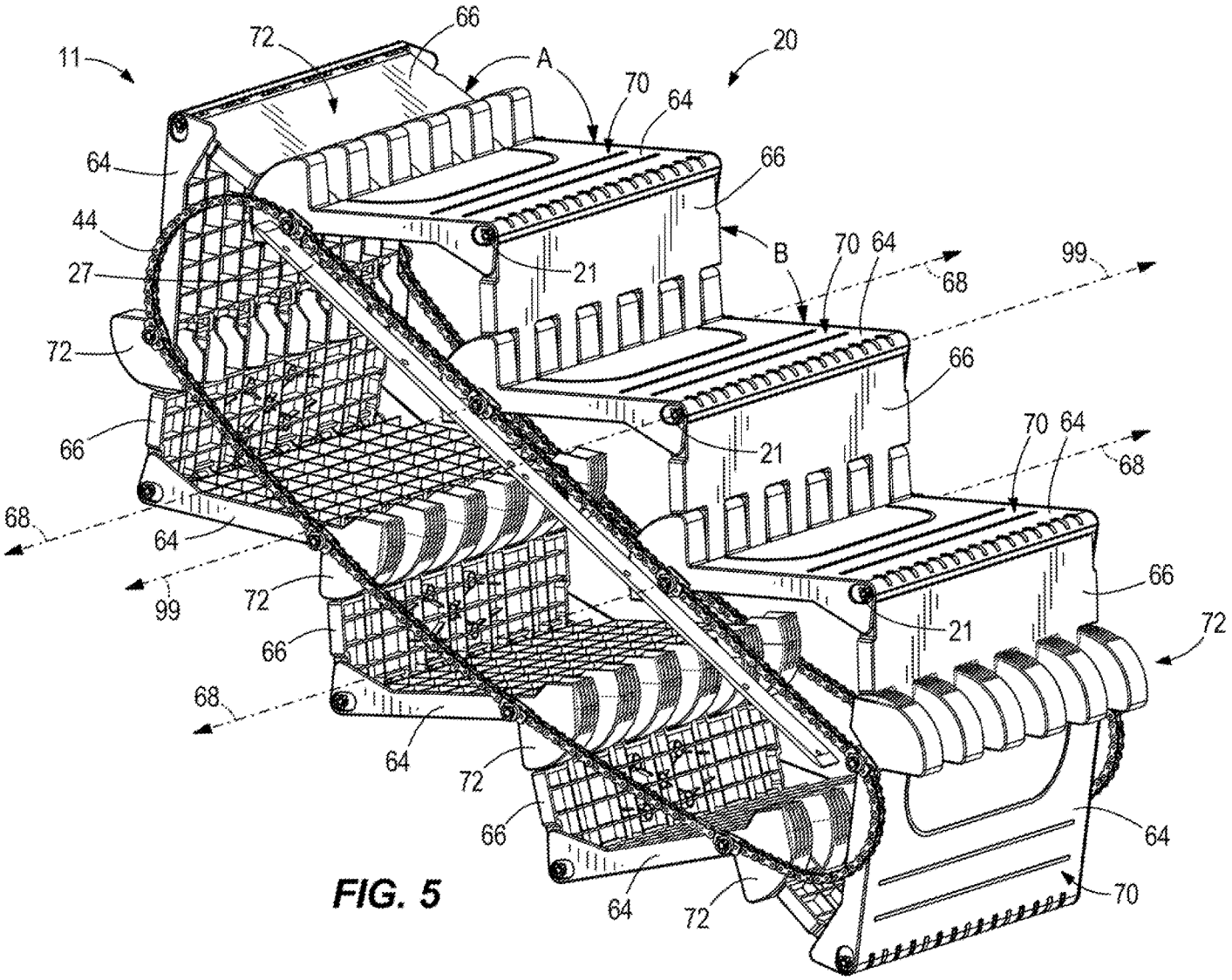
FIG. 5 is a view of a stair apparatus that comprises a plurality of stairs that are pivotably connected together in series and travel in a loop.
Figure 7:
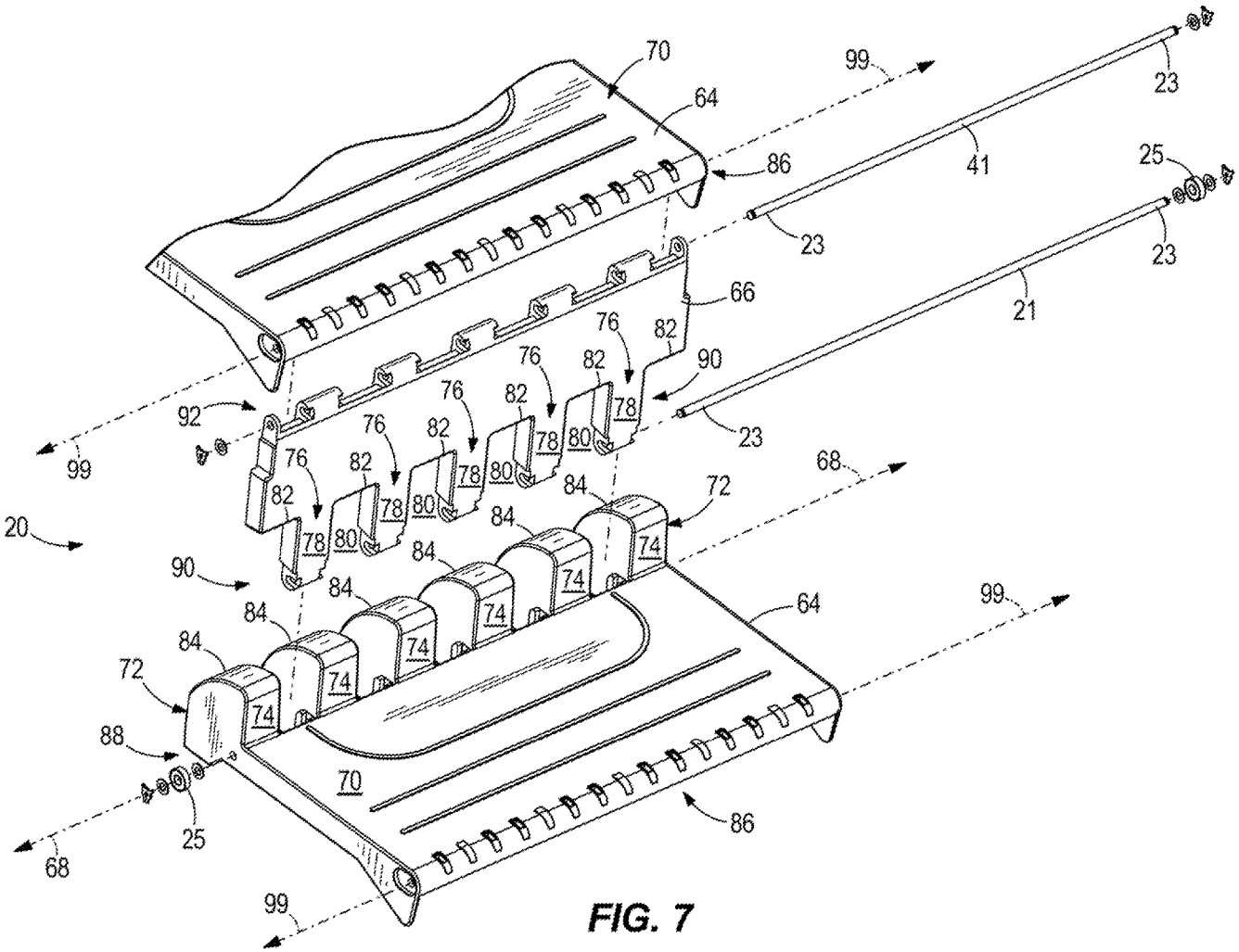
FIG. 7 is an exploded view of a stair apparatus shown in FIG. 5.

Referring to FIGS. 5-7, through research and development, the present inventor has recognized that as each stair 20 travels around the upper sprocket 40 and into the downward direction 24, the riser 66 pivots from an angle A with respect to the tread 64 to a lesser angle B with respect to the tread 64. Through research, it has been found that operators often step onto the uppermost tread surface 70 on the inclined support 14 at the same time as when the riser 66 is pivoting towards the tread surface 70. In such situations, if the operator oversteps the first pivot axis 68 (i.e. the operator's toe oversteps the tread surface), the operator's toe 79 can be impinged upon or pinched by the riser 66 as it pivots into the angle B. This can undesirably result in discomfort and/or injury to the operator.

To prevent such an occurrence, one or a plurality of stopping members 72 is disposed on the tread 64 of each of the stairs 20 in the plurality of stairs 20. Referring to one of the stairs (i.e. a first stair) in FIG. 7, each stopping member 72 has a stop surface 74 that extends transversely upwardly from the tread surface 70. The stop surface 74 is configured to block and thereby prevent the operator's foot 73 from overshooting the first pivot axis 68 and engaging the riser 66 as the operator steps onto the tread surface 70 when the riser 66 is pivoted out of the perpendicular angle B (see FIG. 6) with respect to the tread 64 and more particularly with respect to the tread surface 70. This feature prevents the operator's toe 79 and/or other body part from becoming impinged or pinched by the tread 64 as the tread 64 pivots from the angle shown at A in FIGS. 5 and 6 towards the angle shown at B in FIGS. 5 and 6.

The particular physical configuration of the stopping members 72 and associated stop surfaces 74 can vary from that which is shown. In this example, the stop surface 74 is planar and extends perpendicular to the tread surface 70. Each stopping member 72 in the plurality is spaced apart from the other stopping members 72 in the plurality, and the plurality of stopping members 72 are aligned with respect to the first pivot axis 68. The stop surface 74 extends transversely to and upwardly from the tread surface 70.

Referring to FIG. 7, the riser 66 has a plurality of projections 76 that are interdigitated amongst the plurality of stopping members 72 along the first pivot axis 68. The first pivot axis 68 and pivot shaft 21 extend through the plurality of stopping members 72 and the plurality of projections 76. The plurality of projections 76 also each have stop surfaces 78 that are aligned with the stop surfaces 74 of the plurality of stopping members 72 when the riser 66 is positioned at the noted angle B to the tread surface 70. The plurality of stop surfaces 78 of the plurality of projections 76 is planar. The plurality of projections 76 are spaced apart along the first pivot axis 68 so as to define a plurality of recesses 80 in which the plurality of stopping members 72 are disposed. Each recess 80 has a top edge 82 and each stopping member 72 has a curved back surface 84 alongside of which the top edge 82 travels as the riser 66 is pivoted with respect to the tread 64.

Each tread 64 includes a front edge 86 and a back edge 88. Each riser 66 includes a front edge 90 and a back edge 92. The back edge 88 of the tread 64 is pivotably connected to the front edge 90 of the riser 66 at the noted first pivot axis 68. In this manner, the plurality of stopping members 72 prevent any portion of the operator's foot 73 from overshooting the back edge 88 of the tread 64 as the operator steps onto the tread surface 70 when the riser 66 is pivoted out of the angle B with respect to the tread 64.

Referring to FIG. 6, each adjacent stair 20 in the plurality also has the tread 64 and the riser 66. The tread 64 of an adjacent (e.g. second) stair 20 is pivotably connected to the tread 64 of the noted first stair 20 at the second pivot axis 99, which is parallel to the first pivot axis 68. The tread 64 and riser 66 of the adjacent stair 20 are pivotably connected together along a first pivot axis 68 that is parallel to the second pivot axis 99. Like the first stair 20, the adjacent stair 20 has a stopping member 72 having a stop surface 74 that extends transversely upwardly from a tread surface 70 of the adjacent stair 20 so as to prevent the operator's foot 73 from overshooting the second pivot axis 99 and engaging the riser 66 as the operator steps on the tread surface 70 of the adjacent stair 20 when the riser 66 is pivoted away from the tread 64 of the adjacent stair 20. The remaining stairs 20 in the plurality are similarly configured.

This disclosure thus provides a plurality of stairs 20 that travel in the noted loop around the inclined support 14 in such a manner that when the operator's foot 73 steps on the stair at the upper end portion 18 of the inclined support 14, the operator's toe 79 or any portion of the operator's body will not be impinged upon or pinched by the riser 66 as the riser 66 pivots around the center live shaft 43 and moves from the angle A to the angle B with respect to the tread 64. More specifically, the operator's toe 79 and/or other body parts will be blocked from overshooting the first pivot axis 68 about which the riser 66 pivots, thereby protecting the operator's toe 79 from becoming impinged upon or pinched.

During further research and development, the present inventors have determined that existing stair climber apparatuses do not consistently facilitate a safe reduction in speed of the plurality of stairs down to a zero speed. Rather, existing apparatuses that utilize passive resistance devices can only reduce the speed of the stairs to a certain point, where after application of a mechanical brake is necessary to achieve zero speed. Thus these apparatuses typically cause an abrupt transition from a non-zero speed to zero speed, which can be disconcerting to the operator and can cause undue wear and tear on the apparatus, including for example on the mechanical brake.

The present stair climber apparatus 10 is able to overcome these disadvantages because it employs the electric motor 22, which can be controlled by the control circuit 110 to resist and thereby more smoothly slow the speed of the plurality of stairs 20 down to a zero speed than passive resistance devices. Thereafter, the mechanical brake 48 can be actuated by the control circuit 110 from an unlocked position wherein output of the electric motor 22 to the plurality of stairs 20 is permitted to a locked position wherein output of the electric motor 22 to the plurality of stairs 20 is prevented.

During further research and development, the present inventors have also realized that in some instances, the stair climber apparatus 10 can be difficult to board, especially when the lowermost stair 20 at the lower end portion 16 of the inclined support 14 is not located close to the ground. That is, depending upon when movement of the plurality of stairs 20 was stopped during the previous use of the stair climber apparatus 10, the lowermost stair 20 in the plurality can often located a significant distance away from the ground, for example with an adjacent stair 20 in the plurality being only partially rotated about the lower sprocket 46. This can make it difficult for an operator to step up high enough to board the lowermost stair 20. As a first solution to this problem, the stair climber apparatus 10 has step-assist steps 61, which are fixed onto the frame 12 and provide a fixed initial step for the foot of the operator. However, in addition to this solution, the inventors have realized that it also would be beneficial to allow the operator to temporarily control the stair climber apparatus 10 to move the plurality of stairs 20 to thereby bring one of the plurality of stairs 20 closer to the ground, thus decreasing the height of which the operator needs to initially step up onto the stair climber apparatus 10.

In some examples directed to these objectives, the stair climber apparatus 10 includes the noted second operator input device 120, which is located at the lower end portion 16 of the inclined support 14. In this example, the second operator input device 120 is located on one of the handles 35 of the frame 12 and is oriented outwardly with respect to the entryway to the plurality of stairs 20; however the location of the second operator input device 120 can vary from that shown, as long as the second operator input device 120 can be accessed by the operator when the operator is standing near the lower end portion 16 of the inclined support 14 prior to boarding the stair climber apparatus 10. The second operator input device 120 is electrically connected to the control circuit 110 via a wired or wireless link (not shown) and is thereby configured to input a boarding command from the operator to the control circuit 110. Upon receipt of the boarding command, the control circuit 110 can be programmed to control the electric motor 22 so as to move the plurality of stairs 20 along the inclined support 14 to thereby facilitate an operator stepping up onto the lowermost stair 20 in the plurality. In this particular example the second operator input device 120 is a switch or pushbutton; however the type of operator input device 120 can vary, similar to the various other operator input devices described herein above.

In certain examples, upon an operator's input of the boarding command, the control circuit 110 is programmed to control the electric motor 22 so as to move the plurality of stairs 20 in the upward direction 26 along the inclined support 14. The inventors have found that it can be advantageous to program the control circuit 110 to control the electric motor 22 to move the plurality of stairs 20 in the upward direction 26 so that when the operator steps on the lowermost stair 20, the movement of the plurality of stairs 20 in the upward direction 26 helps lift the operator up onto the apparatus 10.

Upon the operator's input of the boarding command, the control circuit 110 can be programmed to control the electric motor 22 for a predetermined time period. The length of the predetermined time period can be saved in the memory of the control circuit 110 and can be a time period that is sufficient to bring a next stair 20 around the pair of lower sprockets 46 and into a lowermost position (i.e. a position closest to the ground along the inclined support) in which the operator can place his or her foot onto the tread surface 70. In certain other examples, based on the operator's input of the boarding command, the control circuit 110 is programmed to control the electric motor 22 so as to move the plurality of stairs 20 in the upward direction 26 a predetermined distance along the inclined support 14. The predetermined distance can be saved in the memory of the control circuit 110 and can be a predetermined minimum distance that is required to bring a new stair of the plurality of stairs 20 around the pair of lower sprockets 46 and into the noted lowermost position. The lowermost position optionally can be a position in which the tread 64 of the stair 20 is horizontally positioned with respect to the ground; however this is not required. For example, the lowermost position can be a position in which the tread 64 is positioned at an angle to the ground so that the leading edge (front edge 86) of the tread 64 is located closer to the ground than the trailing edge (back edge 88) of the tread 64, thus promoting an even easier first step up by the operator.

If the control circuit 110 is programmed to control the electric motor 22 so as to move the plurality of stairs 20 in the upward direction 26, the lowermost position can be a position in which the stair 20 has travelled all the way around the pair of sprockets 46 at the lower end portion 16 of the inclined support 14. If the control circuit 110 is programmed to control the electric motor 22 so as to move the plurality of stairs 20 in the downward direction 24, the lowermost position can be a position in which the stair 20 has moved from a location on the inclined support 14 to a lower position on the inclined support 14, located closer to the ground. This may likely require that an adjacent stair 20 travel around the pair of sprockets 46 in the downward direction.

In any of the above-mentioned examples, the control circuit 110 also can be programmed to control the electric motor 22 so as to move the plurality of stairs 20 along the inclined support 14 at a predetermined speed, which can be saved in the memory.

In certain other examples, actuation of the second operator input device 120 causes the control circuit 110 to control the electric motor 22 to move the plurality of stairs 20 in the upward direction 26 along the inclined support 14 until a predetermined time after actuation of the second operator input device 120 ceases. In these examples, it can be beneficial to locate the second operator input device 120 so that the second input device 120 is accessible to the operator when the operator is standing on the ground next to the entryway of the plurality of stairs 20, but is not accessible to the operator once the operator has boarded the plurality of stairs 20 and is located on a position wherein it is possible to provide operator inputs to the operator input devices at the upper end portion 18 of the stair climber apparatus 10. For example, the operator can begin to actuate the second operator input device 120 to initiate movement of the plurality of stairs 20. As the operator boards the plurality of stairs 20, the operator can release the second operator input device 120 and the moving stairs 20 can carry the operator up onto the inclined support 14. After a predetermined time period, the control circuit 110 can be programmed to stop movement of the plurality of stairs 20, thereby positioning the operator in the center of the inclined support. One example of this type of configuration is shown in the figures, wherein the second operator input device 120 is located on the handles 35 and faces away from the plurality of stairs 20.

Each of the above embodiments can be programmed into the control circuit 110 so as to automatically occur when the operator actuates the second operator input device 120. The second operator input devices 120 can include switches, control panels, and/or the like, wherein the operator can selectively control the direction, time, and speed of movement of the plurality of stairs 20 so as to facilitate easier mounting onto the plurality of stairs 20.

Figure 8:
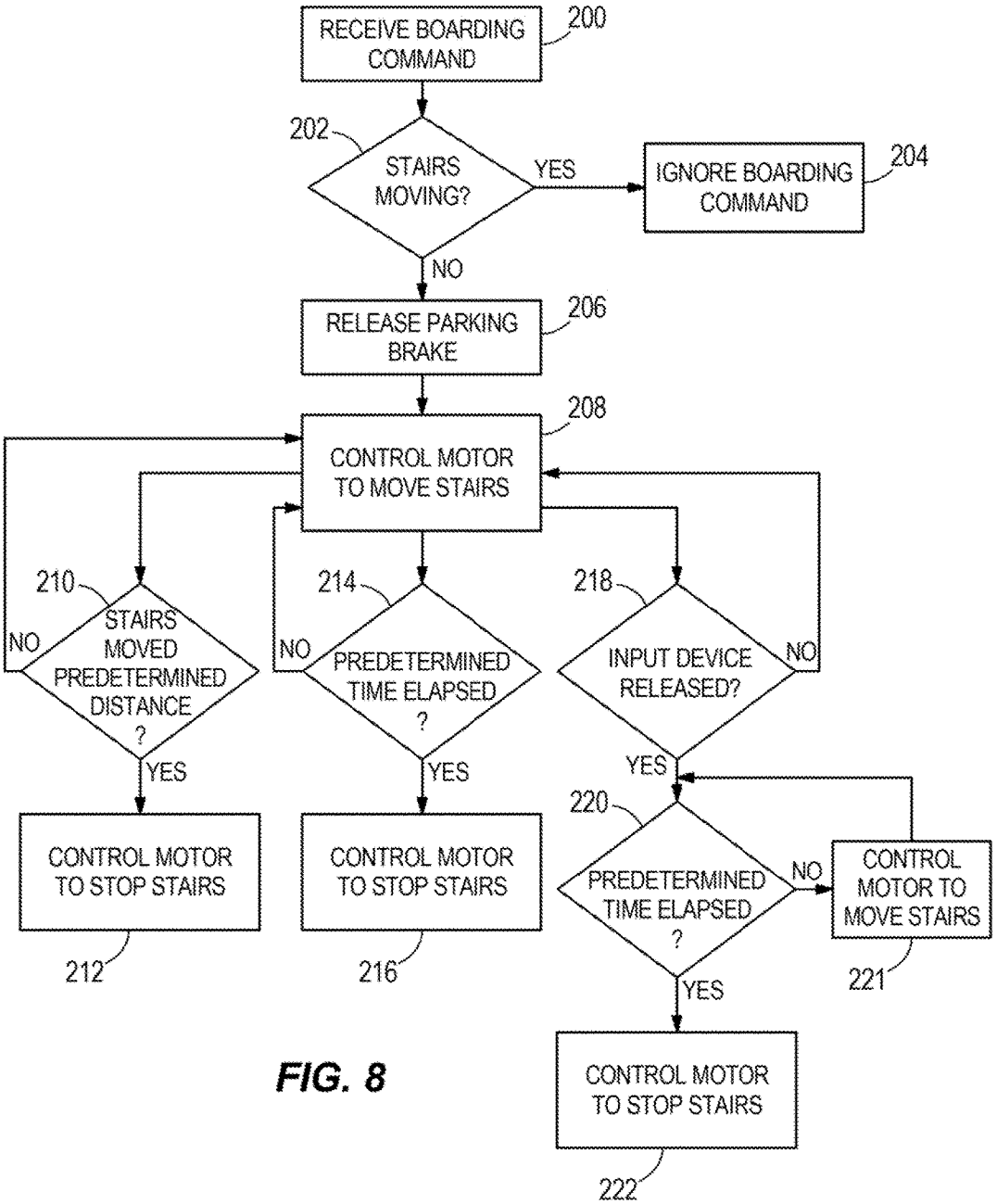
FIG. 8 is a flow chart showing one example of a method of operating the stair climber apparatus shown in FIGS. 1-7.

FIG. 8 depicts one example of a method of operating the stair climber apparatus 10 according to the examples described herein above. At step 200, the control circuit 110 receives a boarding command from the second operator input device 120, as input by an operator standing on the ground adjacent the lower end portion 16. At step 202, the control circuit 110 is programmed to determine whether the plurality of stairs 20 is currently moving. If yes, at step 204, the control circuit 110 is programmed to ignore the boarding command. If no, at step 206, the control circuit 110 is programmed to causes the mechanical brake 48 to move from the noted locked position to the unlocked position. Thereafter, at step 208, the control circuit 110 is programmed to control the electric motor 22 to move the plurality of stairs 20 along the inclined support 14 to bring a next stair in the plurality of stairs 20 into the noted lowermost position at the lower end portion 16. The control circuit 110 can be programmed to operate in a number of different ways, as described herein above. For example, at step 210, the control circuit 110 is programmed to determine whether the plurality of stairs 20 have been moved a predetermined distance. This can be determined based upon feedback from the encoder 111. If no, at step 208, the control circuit 110 is programmed to continue to move the plurality of stairs 20. If yes, at step 212, the control circuit 110 is programmed to control the electric motor 22 to slow the plurality of stairs 20 down to a zero speed. In another example, at step 214, the control circuit 110 is programmed to determine whether a predetermined time period has elapsed since the operator input the boarding command. If no, at step 208, the control circuit 110 can be programmed to continue to move the plurality of stairs 20. If yes, at step 216, the control circuit 110 can be programmed to control the electric motor 22 to slow the plurality of stairs 20 down to a zero speed.

In yet another example, at step 218, the control circuit 110 is programmed to determine whether the second operator input device 120 has been released. If no, at step 208, the control circuit 110 is programmed to continue to control the electric motor 22 to move the plurality of stairs 20. If yes, at step 220, the control circuit 110 can be programmed to determine whether a predetermined time period has elapsed. If no, the control circuit 110 can continue to control the electric motor 22 to move the plurality of stairs 20 at step 221. If yes, at step 222, the control circuit 110 can control the electric motor 22 to stop the plurality of stairs 20. This example applies where the operator first inputs the boarding command to the second operator input device 120 and thereafter releases the second operator input device 120 once the operator has boarded the plurality of stairs 20.

During further research and development, the present inventors have determined that it is desirable to provide a stair climber apparatus and method that better identifies a situation where an operator may have stepped off and/or fallen from the machine, and thereafter more quickly decrease the speed of the plurality of stairs down to a zero speed. This can avoid potential injury to the operator, which can occur if the operator falls and the plurality of stairs 20 continue to move.

As described herein above, in certain examples, the control circuit 110 is programmed to control the speed of the electric motor 22 and the output direction of the electric motor 22 between the noted forward and reverse directions. The control circuit 110 also is programmed to control the speed of the electric motor 22 to maintain a constant speed of travel of the plurality of stairs 20 in the downward direction 24 along the inclined support 14 as the operator is stepping on the plurality of stairs 20 in the upward direction 26. To achieve this, the control circuit 110 normally controls the electric motor 22 to apply a braking force (i.e. to resist) movement of the stairs 20 in the downward direction caused by the operator's stepping motion. In other words, the control circuit 110 typically will control the output of the electric motor 22 in the reverse torque direction to brake and maintain constant speed of travel of the plurality of stairs 20 along the inclined support 14 as the operator is stepping in the upward direction 26 on the plurality of stairs 20. The control circuit 110 typically will control the electric motor 22 in the forward torque direction to drive the plurality of stairs 20 and thereby maintain the constant speed of travel of the plurality of stairs 20 along the inclined support 14 when the operator stops stepping in the upward direction 26 on the plurality of stairs 20, for example when a fall occurs. Advantageously, in this example, the control circuit 110 is further programmed such that when a change in output torque direction of the electric motor 22 is required to maintain the noted constant speed of travel of the plurality of stairs 20, the control circuit 110 automatically controls the speed of the electric motor 22 down to a zero speed. Thereafter, the control circuit 110 can optionally be programmed to actuate the mechanical brake 48 out of the unlocked position and into the locked position to secure the plurality of stairs 20 in position.

Figure 9:
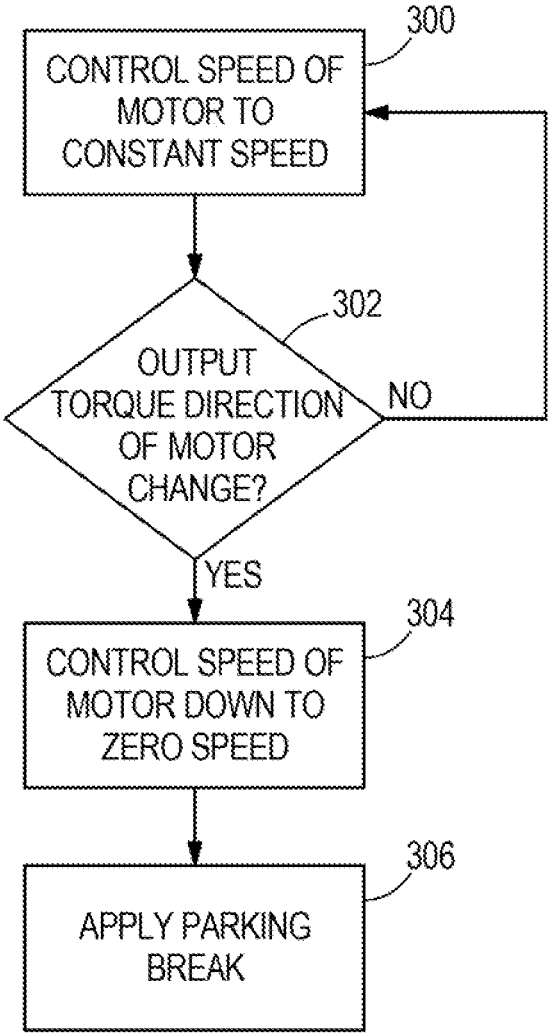
FIG. 9 is a flow chart showing another example of a method of operating the stair climber apparatus shown in FIGS. 1-7.

FIG. 9 depicts one example of a method according to the above described embodiment. At step 300, the control circuit 110 is programmed to control the speed of the electric motor 22 to a constant speed, which optionally can be a speed that is input by the operator via the first input device 19. At step 302, the control circuit 110 is programmed to identify when a change in output torque direction of the electric motor 22 is required to maintain that constant speed. If no, the control circuit 110 continues operation at step 300. If yes, at step 304, the control circuit 110 is programmed to control speed of the electric motor down to zero speed. At optional step 306, the control circuit 110 can be programmed to apply the mechanical brake 48 into the locked position.

In certain examples, the control circuit 110 can be programmed to instantaneously act to reduce the speed of the electric motor 22 to a zero speed when a change in output torque direction occurs; however in other examples, the control circuit 110 can be programmed to wait to act depending upon the current speed of movement of the plurality of stairs 20 and/or depending upon the amount of time that has elapsed since the change output direction occurred. For example, the control circuit 110 can be programmed to react slower to changes in output direction that occur at lower speeds than changes in output direction that occur at higher speeds. In some examples, the control circuit 110 can operate based upon input from a timer wherein the control circuit 110 only controls the speed of the electric motor 22 down to the noted zero speed after a predetermined time period has elapsed since the change in direction of the electric motor torque output has occurred. This accommodates situations where the operator might be stepping up more than one step at a time, for example. In other examples, the control circuit 110 can be programmed to control the speed of the electric motor 22 down to zero speed only when the speed of the electric motor 22 is above a speed threshold that is saved in the memory.

In certain other examples, the control circuit 110 can be programmed to control the speed of the electric motor 22 down to the noted zero speed only after (1) a first time period elapses (e.g. two seconds) or (2) a second, greater time period elapses and the speed of the electric motor 22 is above a threshold speed. This accommodates different exercise activities wherein the plurality of stairs 20 are moving various speeds and potentially more than one step are being taken by the operator at a time.

Figure 10:
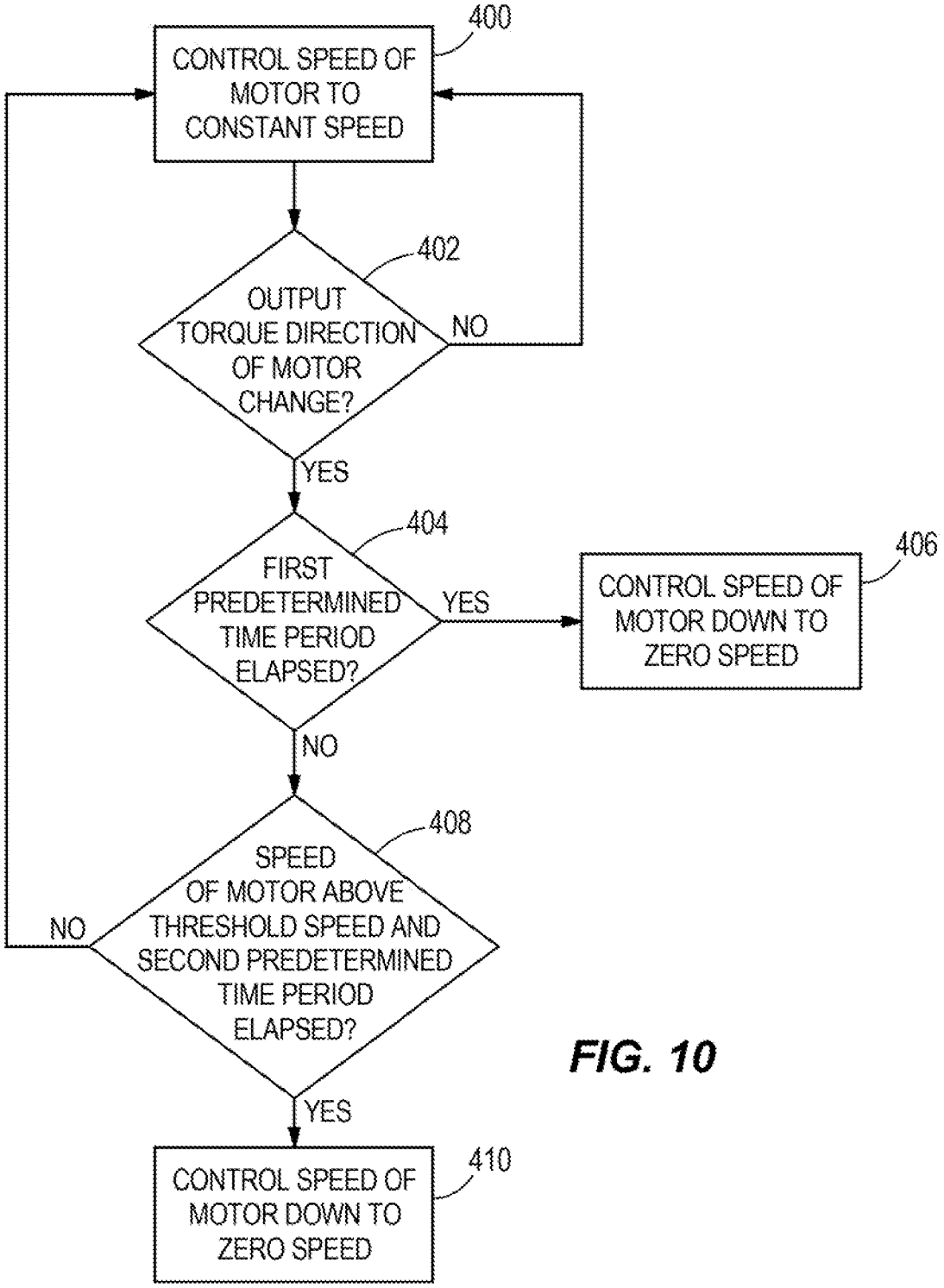
FIG. 10 is a flow chart showing yet another example of a method of operating the stair climber apparatus shown in FIGS. 1-7.

FIG. 10 depicts another example of a method according to the above described embodiments. At step 400, the control circuit 110 is programmed to control the speed of the electric motor 22 to a constant speed. At step 402, the control circuit 110 is configured to identify when a change in output torque direction of the electric motor 22 is required to maintain the noted constant speed of the plurality of stairs 20. If no, the control circuit 110 continues to operate at step 400. If yes, at step 404, the control circuit 110 identifies whether a first predetermined time period (e.g. two seconds) has elapsed. If yes, at step 406, the control circuit 110 controls the speed of the electric motor 22 down to a zero speed. If no, at step 408, the control circuit 110 identifies whether the speed of the electric motor 22 is above a threshold speed stored in the memory and a lesser, second threshold time period has elapsed. If yes, the control circuit 110 continues operation at step 400. If no, at step 410, the control circuit 110 controls the speed of the electric motor 22 down to a zero speed.

What is claimed is:

1. A stair climber apparatus comprising:

a frame having an inclined support;

a plurality of stairs that are connected together in series and configured to travel around the inclined support;

an electric motor that is operably connected to the plurality of stairs and configured to start, maintain and stop travel of the plurality of stairs around the inclined support;

a controller that is configured to (i) control a speed of the electric motor and an output torque direction of the electric motor so as to maintain a constant speed of travel of the plurality of stairs in a downward direction along the inclined support, and alternately to (ii) control the speed of the electric motor down to a zero speed so as to stop travel of the plurality of stairs along the inclined support;

wherein as an operator steps on the plurality of stairs in an upward direction along the inclined support, the controller is configured to control the speed of the electric motor and the output torque direction of the electric motor to maintain the constant speed of travel of the plurality of stairs in the downward direction along the inclined support;

wherein thereafter when the operator steps off of the plurality of stairs, the controller is configured to control the speed of the electric motor and change the output torque direction of the electric motor to thereby maintain the constant speed of travel of the plurality of stairs in the downward direction along the inclined support; and wherein thereafter, based directly upon the change in output torque direction of the electric motor, the controller is further configured to automatically control the speed of the electric motor down to the zero speed.

2. The stair climber apparatus according to claim 1, further comprising an input device via which the operator can input the constant speed to the controller.

3. The stair climber apparatus according to claim 2, wherein the input device is disposed on top of the inclined support.

4. The stair climber apparatus according to claim 1, wherein the controller is configured to control the speed of the electric motor down to the zero speed only after a predetermined time period elapses after the change in output torque direction of the electric motor.

5. The stair climber apparatus according to claim 1, wherein the controller is configured to control the speed of the electric motor down to the zero speed only when the speed of the electric motor is above a threshold speed after the change in output torque direction of the electric motor.

6. The stair climber apparatus according to claim 1, further comprising a timer that is configured to count a time that elapses after the change in output torque direction of the electric motor, wherein the controller is configured to control the speed of the electric motor down to the zero speed only after the timer counts a time that equals a predetermined time period from the change in output torque direction of the electric motor; and wherein when, after the change in output torque direction of the electric motor, the controller causes a subsequent change in output torque direction of the electric motor in order to maintain the constant speed of travel of the plurality of stairs in the downward direction along the inclined support, the controller is configured to reset the timer to zero.

7. The stair climber apparatus according to claim 1, further comprising a mechanical brake that is movable between a locked position wherein movement of the plurality of stairs by the electric motor is prevented and an unlocked position wherein movement of the plurality of stairs by the electric motor is permitted.

8. The stair climber apparatus according to claim 1, further comprising an encoder that is configured to detect the speed of the electric motor and the output torque direction of the electric motor.

9. The stair climber apparatus according to claim 1, wherein the electric motor is an asynchronous electric motor.

10. A method of operating a stair climber apparatus having an inclined support and a plurality of stairs that are connected together in series and configured to travel around the inclined support, the method comprising:

controlling a speed of an electric motor and an output torque direction of the electric motor that is operably connected to the plurality of stairs and configured to start, maintain and stop travel of the plurality of stairs along the inclined support;

controlling, as an operator steps on the plurality of stairs in an upward direction along the inclined support, the speed of the electric motor and the output torque direction of the electric motor to maintain the constant speed of travel of the plurality of stairs in the downward direction along the inclined support;

controlling thereafter, when an operator steps off of the plurality of stairs, the speed of the electric motor and changing the output torque direction of the electric motor to thereby maintain the constant speed of travel of the plurality of stairs in the downward direction along the inclined support; and automatically controlling, based directly upon the change in output torque direction of the electric motor, the speed of the electric motor down to a zero speed.

11. The method according to claim 10, further comprising controlling the speed of the electric motor down to the zero speed only after a predetermined time period elapses.

12. The method according to claim 11, further comprising controlling the speed of the electric motor down to the zero speed only if the speed of the electric motor is above a threshold speed.

13. The method according to claim 11, further comprising subsequently moving a mechanical brake into a locked position wherein movement of the plurality of stairs by the electric motor is prevented.

* * * * *